US005386671A

United States Patent [19]

Hu et al.

[11] Patent Number: 5,386,671

[45] Date of Patent: Feb. 7, 1995

[54] STIFFNESS DECOUPLER FOR BASE ISOLATION OF STRUCTURES

[75] Inventors: Kuo-Kuang Hu; Philip G. Kirmser; Stuart E. Swartz, all of Manhattan, Kans.

[73] Assignee: Kansas State University Research Foundation, Manhattan, Kans.

[21] Appl. No.: 957,756

[22] Filed: Oct. 7, 1992

Related U.S. Application Data

[63] Continuation of Ser. No. 677,159, Mar. 29, 1991, abandoned.

[51] Int. Cl.[6] ..... E04H 9/02

[52] U.S. Cl. ..... 52/167.3; 52/295; 52/301; 52/724

[58] Field of Search ..... 52/167 R, 167 CB, 295, 52/296, 297, 301, 283, 724, 725, 728, 727, 126.1, 126.6, 655, 79.12

[56] References Cited

U.S. PATENT DOCUMENTS

| | | | |
|---|---|---|---|
| 862,681 | 8/1907 | Tresidder | 52/301 |
| 1,190,002 | 7/1916 | Picuri | 52/283 |
| 1,602,828 | 10/1926 | Lally | 52/725 |
| 2,053,226 | 9/1936 | Ruge | 52/167 CB |
| 2,943,716 | 7/1960 | Babcock | 52/126.1 |
| 3,110,982 | 11/1963 | Besinger | 52/283 |
| 3,418,768 | 12/1968 | Cardan | 52/655 |
| 3,606,704 | 9/1971 | Denton | 52/167 CB |
| 4,766,708 | 8/1988 | Sing | 52/79.12 |

FOREIGN PATENT DOCUMENTS

| | | | |
|---|---|---|---|
| 2254974 | 7/1975 | France | 52/167 |
| 353308 | 10/1937 | Italy | 52/655 |
| 485924 | 3/1970 | Switzerland | 52/725 |

*Primary Examiner*—Carl D. Friedman
*Assistant Examiner*—Kien Nguyen
*Attorney, Agent, or Firm*—Hovey, Williams, Timmons & Collins

[57] ABSTRACT

A stiffness decoupling assembly (22) is provided for the protection of buildings or other structures (20) subject to earthquakes, in order to prevent collapse or catastrophic failure of such structures (20). The preferred decoupling assembly (22) includes a plurality of elongated, relatively flexible, concrete-filled pipes (28) rigidly connected to the structure (20) and extending downwardly toward an underlying foundation (26), with at least certain of the pipes (28) being coupled to the foundation (26) for resisting overturning of the structure (20). A primary load-bearing column (46) rests upon the foundation (26) and receives the array of pipes (28); bearing means (32) is interposed between the upper end of the column (46) and structure (20) for permitting relatively lateral movement therebetween. The invention serves to decouple the lateral stiffness from the load-carrying strength of the column (46), to thereby reduce the transmissibility of ground acceleration to the protected structure (20).

22 Claims, 4 Drawing Sheets

STIFFNESS DECOUPLER FOR BASE ISOLATION OF STRUCTURES

This application is a file wrapper continuation of application Ser. No. 07/677,159, filed Mar. 29, 1991, now abandoned.

BACKGROUND OF THE INVENTION

1. Field of the Invention

The present invention is broadly concerned with stiffness decoupling assemblies to be used in the construction of earthquake-resistant structures such as multi-story buildings or bridges. The assemblies of the invention effectively decouple the lateral stiffness of the structure in question from the load-bearing strength of the supporting column system for the structure. In this way, the dynamic behavior of a structure under seismic excitation is effectively controlled, while nevertheless retaining the necessary load-bearing strength, damping strength and natural period for the structure. Advantageously, the stiffness decouplers of the invention include a plurality of elongated, concrete-filled pipes rigidly secured to a structure, together with a surrounding, primary load-bearing column extending between an underlying foundation and the structure, and receiving the pipes; low-friction bearings are provided between the columns and structure, in order to permit relative lateral movement therebetween.

2. Description of the Prior Art

Architects and structural engineers have long grappled with the problem of designing buildings, bridges or other structures in areas prone to seismic events. The recent earthquake in San Francisco is but one of many examples of the potentially catastrophic consequences of improper building design in such locales.

Many proposals have been made in the past aimed at increasing the safety of earthquake-resistance of various structures. In general, most modern day proposals have attempted to combine the qualities of strength (that is, the ability to withstand large forces while remaining elastic), deformability and energy-absorbing capacity. For example, it is known to employ large elastomeric bearings to support ductile reinforced concrete frame structures, in order to isolate the structure from its underlying foundation. However, such bearings can be expensive, and moreover some are subject to environmental degradation.

It has also been suggested in the past to make use of mild steel energy-absorbing devices which are rigid under service-type loading, but yield and absorb energy under large earthquake-type loading. Such schemes rely on the hysteretic energy-absorbing capacity of steel bars used as base-isolating devices.

Despite intensive on-going research in this area, however, workers in the art have failed to heretofore develop a truly effective base isolation system which is economical, easy to install, long-lived and capable of absorbing potentially destructive seismic forces while preventing collapse of the supported structure.

SUMMARY OF THE INVENTION

The present invention overcomes the problems outlined above and provides a novel stiffness decoupling assembly designed to give enhanced earthquake protection to structures such as buildings and bridges. The decoupling assembly of the invention serves to decouple the lateral stiffness from the load-carrying strength of the column system supporting the structure, to thereby reduce the transmissibility of ground acceleration to the isolated structures.

In preferred forms, the invention contemplates use of a plurality of elongated, relatively flexible, hollow pipes rigidly connected adjacent the upper ends thereof to a protected structure, with the pipes extending downwardly towards the underlying foundation for the structure. At least certain of the pipes (and preferably all) are filled with material for damping induced movement of the pipes; preferably, the pipes are filled with concrete for this purpose. In addition, the overall decoupling assembly includes means operatively coupling at least certain of the pipes to the foundation for resisting overturning of the structure. Advantageously, such pipes are coupled to the foundation in a manner permitting limited upper shifting movement thereof against an increasing biasing force.

A primary load-bearing member also forms a part of the complete decoupling assembly and is located in spaced relationship to the plurality of pipes. Typically, a hollow, unitary square or circular in cross-section reinforced concrete column is employed for this purpose, with the plural pipes extending downwardly through the column. This load-bearing member rests upon the foundation and extends upwardly toward the structure to present an upper end. Bearings are interposed between the load-bearing member and the structure for engaging both of the latter and permitting relative lateral movement therebetween.

In actual practice, a given structure will be provided with decoupling assemblies, provided at the location of all conventional load-bearing columns, but provided with the bearing structure and internal pipes described previously.

DESCRIPTION OF THE PREFERRED EMBODIMENTS

Figure 1:
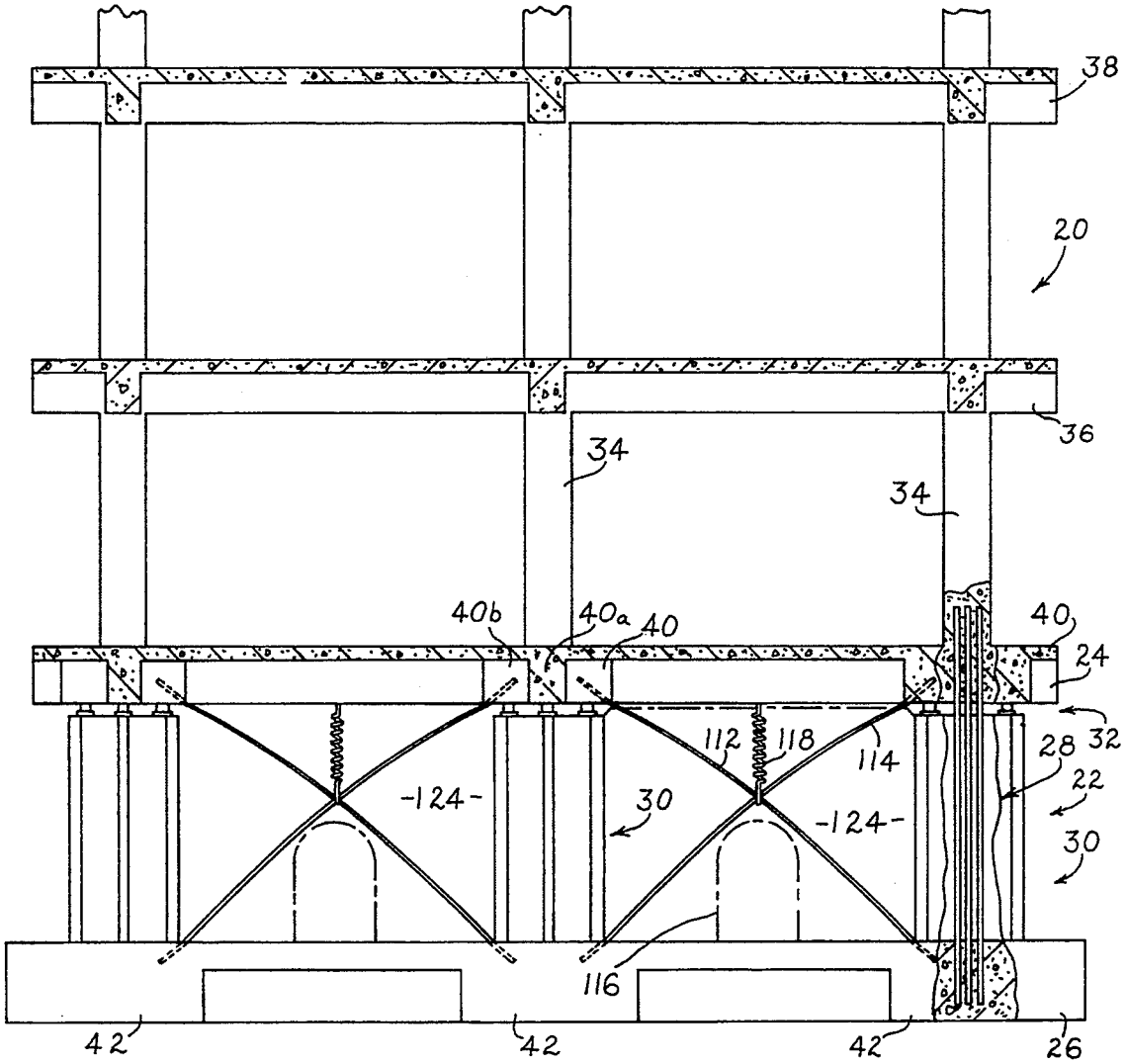
FIG. 1 is a fragmentary view, with parts broken away for clarity, of the structural frame of a multi-story building, with the decoupling assemblies of the present invention in place between the frame base and an underlying foundation.

Turning now to the drawings and particularly FIG. 1, the skeletal frame 20 of a multi-story building is illustrated, in conjunction with a plurality of stiffness decoupling assemblies 22, the latter being interposed between the base 24 of frame 20 and an underlying reinforced concrete foundation 26. Broadly speaking, each decoupling assembly 22 includes a plurality of elongated, relatively flexible hollow pipes 28, a hollow, unitary, upright, load-bearing column 30 in surrounding relationship to the pipes 28, and bearing means broadly referred to by the numeral 32 operatively interposed between the underside of frame 20 and the upper ends of the respective columns 30.

In more detail, the skeletal frame 20 is entirely conventional and includes, in addition to the base 24, the usual upright columns 34 and separate story floors 36, 38. The frame 20 is typically formed of any desired construction material such as reinforced concrete and presents, at strategic locations, conventional support areas 40 forming a part of the base 24. Each of the support areas 40 presents, in the illustrated example, a pair of transverse horizontal beams 40*a*, 40*b*.

Likewise, the foundation 26 is of the usual variety (except for the modifications herein described associated with the pipes 28), and has footings 42; the foundation 26 is also formed of reinforced concrete.

Figure 3A:
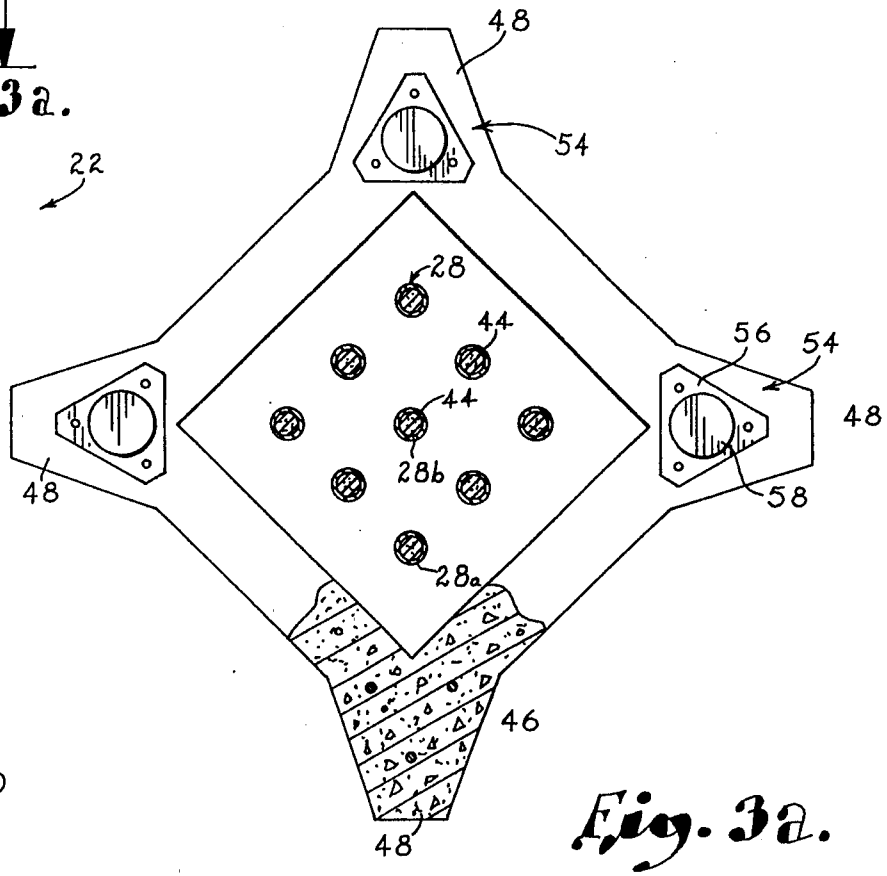
FIG. 3*a* is a sectional view taken along line 3*a*—3*a* of FIG. 2 and with parts broken away illustrating the construction of a decoupling assembly making use of a hollow, square in cross-section reinforced concrete column with respective low-friction bearings at the column corners.
Figure 2:
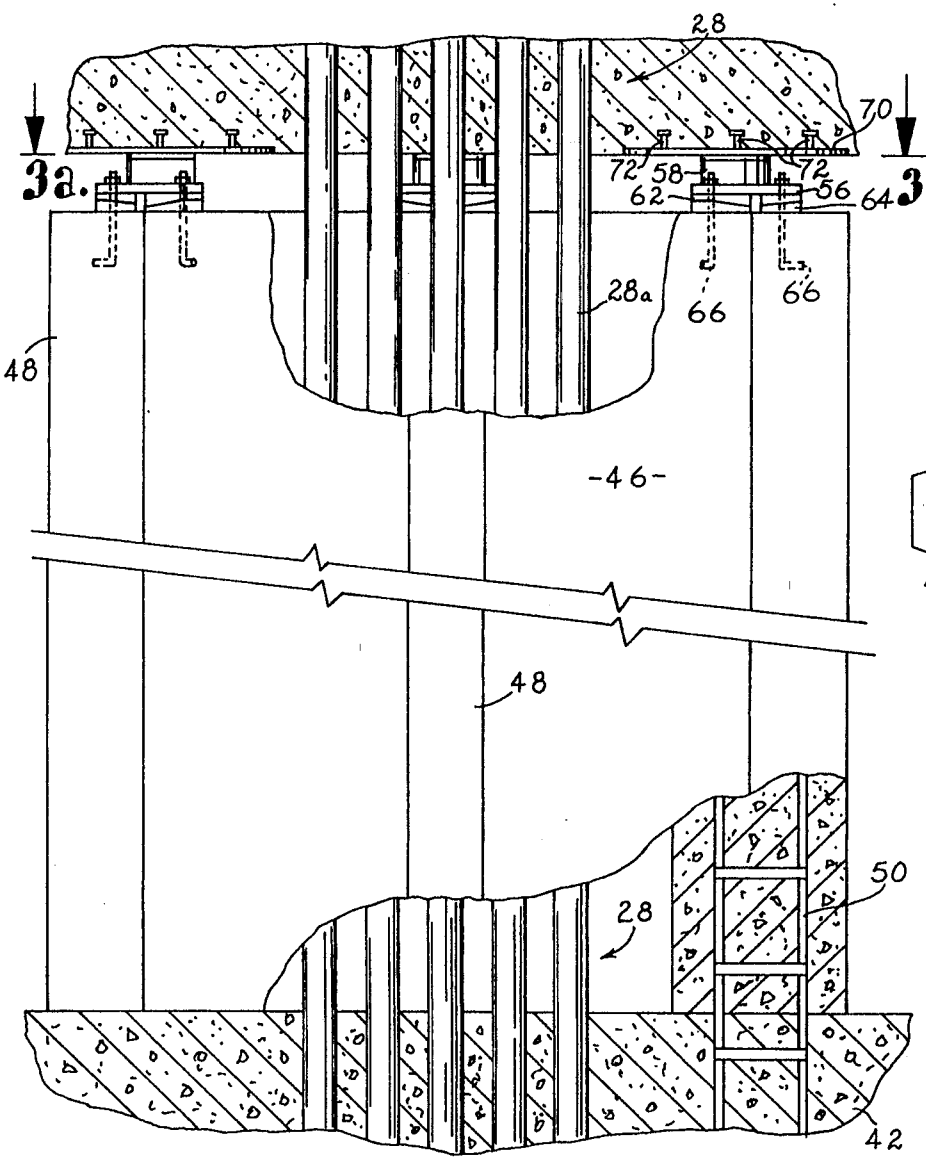
FIG. 2 is a fragmentary view, with parts broken away and certain parts shown in phantom, illustrating important components of a decoupling assembly.

Attention is next directed to FIGS. 2 and 3*a* which illustrate in greater detail one of the decoupling assemblies 22. It will be observed in this respect that the plural pipes 28 are arranged in spaced relationship to each other and present an array with peripheral pipes 28*a* and a central pipe 28*b*. These pipes are of conventional, thin-walled metallic construction, and would typically range in diameter from about ¾ inch to 3 inches. Each of the pipes 28*a*, 28*b* is filled with an appropriate damping material, here concrete 44. The uppermost ends of the pipes 28 extend into and are embedded within the reinforced concrete of support area 40. As viewed in FIG. 1, it will be seen that the pipes extend upwardly through base 24 and into the associated column 34. In order to enhance the rigid connection of the pipes 28 to the frame 20, use may be made of laterally extending flanges or collars (not shown) on the pipes. More broadly, however, the pipes 28 may be secured to a structure such as frame 20 by any convenient and appropriate means, so long as a rigid connection is effected between the structure and the individual pipes. In the embodiment illustrated, the pipes 28 extend into and are embedded within the underlying footing 42 of foundation 26. Here again, other appropriate means of operatively connecting the pipes 28 to foundation 26 may be employed, and two preferred options are described in detail hereinafter.

Each overall assembly 22 further includes an upright, hollow, unitary, primary load-bearing column 46. In the embodiment of FIGS. 1–3*a*, the column 46 is square in cross-section and includes vertical stiffeners 48 under each bearing. As illustrated in FIG. 2, a metallic reinforcement 50 passes through each stiffener 48 and into the underlying foundation 26, in order to enhance the rigidity and lateral stability of the columns 46. In this respect, it will be seen that each of the columns 46 rests atop a footing 42, and extends upwardly towards the skeletal frame 20; at the upper end of each column 46, bearing supports are provided.

Figure 4:
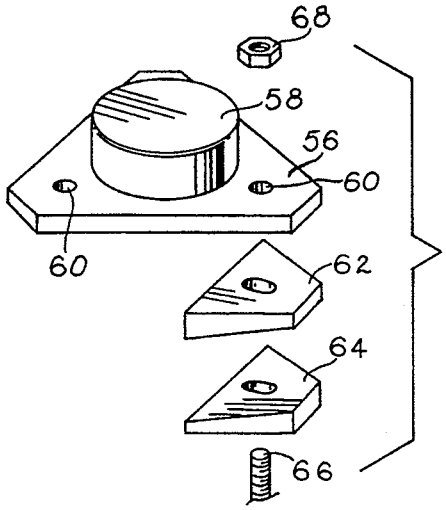
FIG. 4 is an exploded view illustrating the components of a preferred bearing for use in the invention.

The overall bearing means 32 is made up of a number of identical bearing assemblies 54, with each of the latter being positioned beneath a respective beam 40*a*, 40*b*. Each of the bearing assemblies 54 (see FIG. 3*a*) includes a base 56 of truncated triangular configuration, the latter supporting an upstanding bearing pad 58 formed of material having a relatively low coefficient of friction (e.g., bearing alloys formed of bronze, steel, lead or powdered sintered metals, with or without lubrication). The base 56 (see FIG. 4) is provided with an aperture 60 adjacent each corner thereof in order to permit connection of the base to support plate 52. In addition, a pair of oppositely tapered, mated, slotted shims 62, 64 are stacked beneath each corner of base 56, with the slots thereof in registry with the associated aperture 60. A total of three somewhat J-shaped threaded connectors 66 are embedded within the column 46 for each bearing assembly 54 and extend upwardly to pass through the shim slots and apertures 60. Nuts 68 are then employed to secure the bearing assemblies in place on the column. It will be appreciated that provision of the mated shims 62, 64 allows proper adjustment of the height and location of each bearing assembly 54, so as to prevent uneven loading on the bearings and/or to establish a desirable normal loading on the bearings.

The respective bearing pads 58 are adapted to engage the underside of a support area 40 and to permit relative lateral movement between the load-bearing columns 46 and the frame 20. In order to facilitate such operation, a metallic slide plate 70 is secured to the underside of each support area 40 at the region where the pads 58 contact the support area. Each slide plate 70 is secured in place by a number of headed studs 72 embedded within the concrete or otherwise fixed to the associated support area formed of conventional building materials.

Figure 3B:
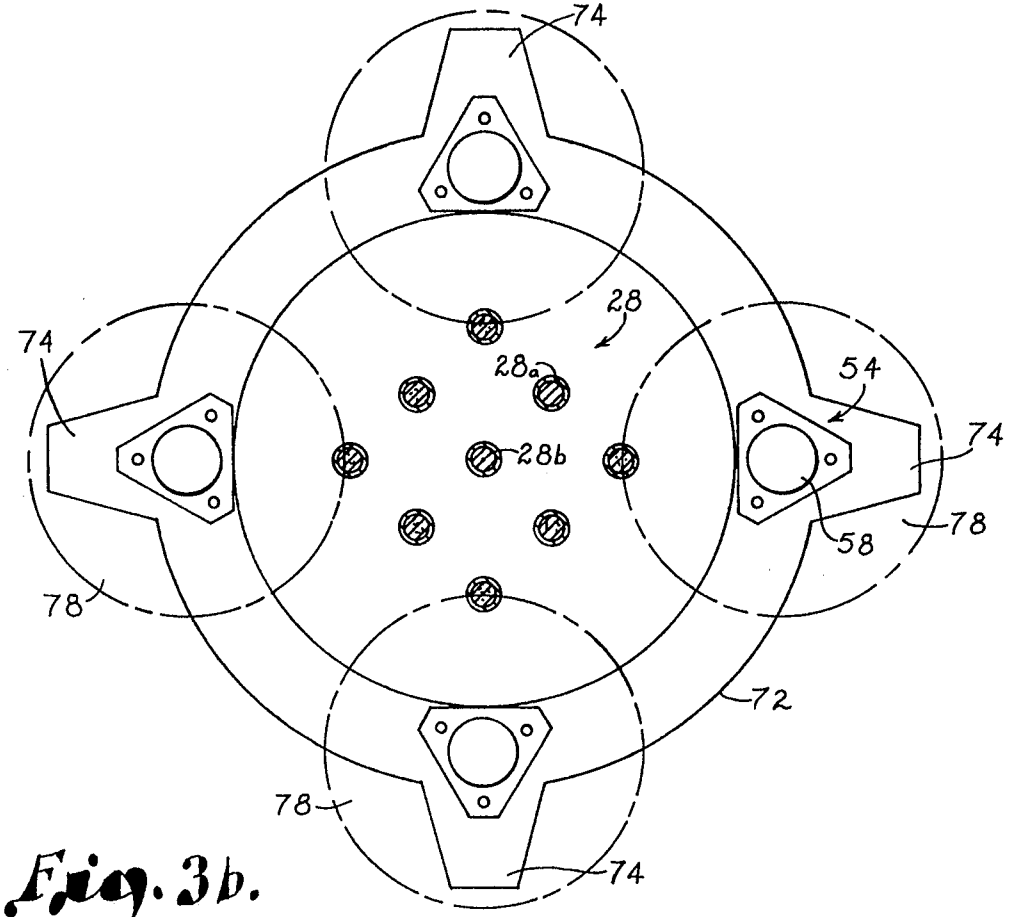
FIG. 3*b* is a view similar to that of FIG. 3*a*, but showing a decoupling assembly wherein use is made of a hollow, circular in cross-section column and spaced low-friction bearings.

FIG. 3*b* illustrates a similar decoupling assembly 22 wherein use is made of a hollow, circular column 72. The latter is also provided with vertical stiffeners 74 at 90° intervals, and the latter have the interconnecting reinforcement 50 embedded therein, as in the case of square column 46. The decoupling assembly 22 of this embodiment also includes the plural, concrete-filled pipes 28, as well as a total of four bearing assemblies 54 above the stiffeners 74. Four separate slide plates 78 are affixed to the underside of the associated support area 40, and coact with a respective bearing pad 58 of each bearing assembly 54.

Figure 10:
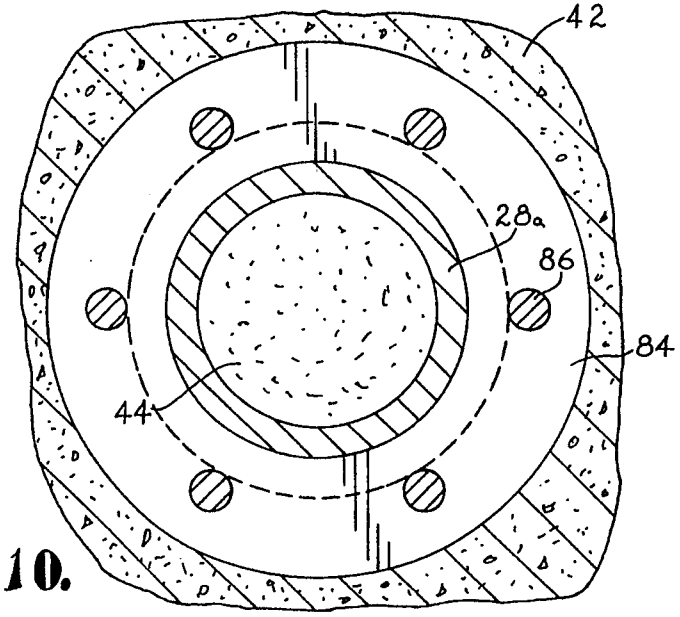
FIG. 10 is a sectional view taken along line 10—10 of FIG. 5 and further illustrating the pipe coupling arrangement.

In preferred forms of the invention, at least the peripheral pipes 28*a* of each array within a respective column 46 or 72 are coupled to the foundation 20 in a manner to permit limited upward shifting movement of the peripheral pipes against an increasing biasing force. Attention is first directed to FIGS. 5 and 10 which illustrate one such coupling arrangement. In particular, a pipe coupling device 80 is provided which includes a pipe-receiving base rigidly secured to a footing 42 and presenting a lowermost support plate 82 and an upper annular retaining ring 84 disposed in spaced relationship above the support plate. In the particular embodiment illustrated, the support plate 82 and ring 84 are embedded within the concrete of the footing 42. Moreover, the retaining ring is further secured against uprooting by means of nut and bolt assemblies 86 likewise embedded in the footing 42. The lowermost end of a pipe 28*a* received within device 80 is provided with an abutment plate 88 which is affixed with welding or other convenient means. The abutment plate 88 is configured and arranged for captively retaining the lowermost end of the pipe 28*a* between support plate 82 and retaining ring 84. A coil spring 90 is located between abutment plate 88 and ring 84 and disposed about the lowermost portion of pipe 28*a* received within device 80. As can be readily understood from the drawings, upward movement of the pipe 28*a* is against the bias of coil spring 90.

Figure 6:
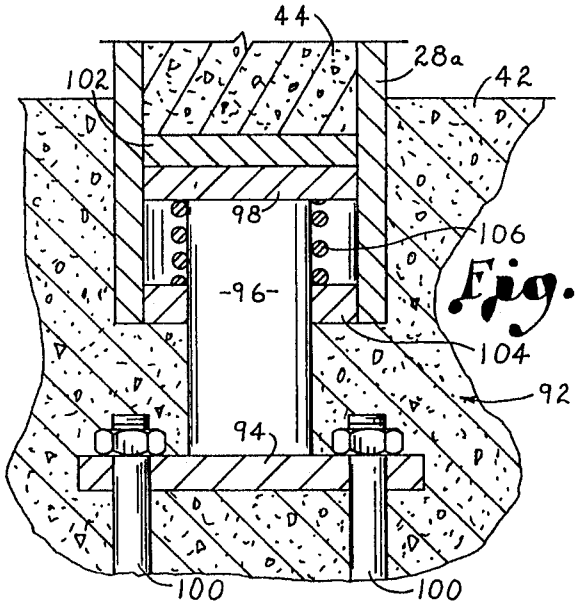
FIG. 6 is a view similar to that of FIG. 5, but showing another type of spring-biased pipe coupling means.

FIG. 6 illustrates another similar pipe coupling device 92. In this instance, the device 92 includes a base 94 rigidly secured to the footing 42 and presenting an upwardly extending pin 96, the latter having an abutment plate 98 securely fixed to the upper end thereof. The base 94 is secured against uprooting by means of embedded nut and bolt assemblies 100.

In this embodiment, the lowermost end of pipe 28*a* is hollow and is provided with an engagement plate 102 and a retaining ring 104. As viewed in FIG. 6, the plate 102 is spaced upwardly from the lowermost butt end of the pipe 28*a* and is within the confines thereof. On the other hand, retaining ring 104 is located below the plate 102 but likewise within the confines of the pipe 28*a*. The ring 104 is of annular configuration and is adapted to slidably received pin 96 as shown; in such orientation, the abutment plate 98 and ring 104 cooperatively serve to retain the upper end of the pin 96 between the engagement plate 102 and retaining ring 104. A coil spring 106 is located between the retaining ring 104 and engagement plate 102 and is disposed about the upper received end of pin 96. Here again, it will be readily observed that upward movement of pipe 28 is against the bias of spring 106.

Figure 7:
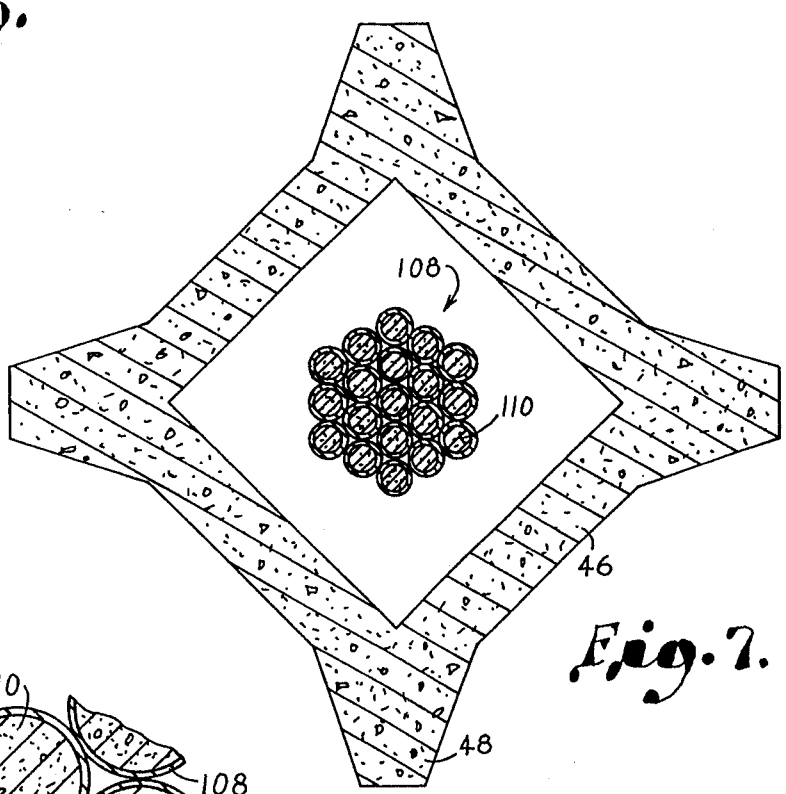
FIG. 7 is a sectional view illustrating components of a decoupling assembly in accordance with the invention, wherein use is made of a bundled plurality of pipes within a hollow column.
Figure 8:
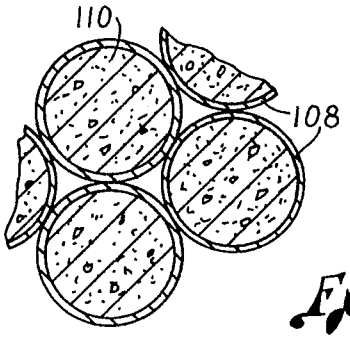
FIG. 8 is an enlarged, fragmentary view illustrating the orientation of pipes in the FIG. 7 embodiment.
Figure 9:
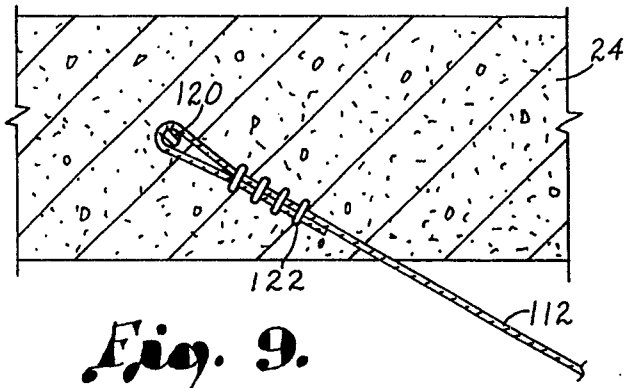
FIG. 9 is a fragmentary view illustrating the securement of one of the secondary reinforcing cables to the building frame base.

Although the pipes 28 illustrated in the embodiments of FIGS. 1–3*a* and 3*b* are located in spaced relationship to each other, the invention is not so limited. For example, a plurality of pipes 108 may be employed (see FIGS. 7–8) wherein the individual concrete-filled pipes are placed in contact with one another to form a bundled array. Such pipes would also be substantially filled with concrete 110 or similar damping material. While the particular type of pipe array is not critical, it is important to locate the pipes in sufficiently spaced relationship from the defining walls of the surrounding column or other support member to prevent significant contact between the pipes and the support member during a seismic occurrence. As best seen in FIGS. 3*a* and 7, the minimum distance between the load-bearing member (i.e., column 46) and the pipe located closest thereto is greater than the maximum cross-sectional dimension (i.e., the diameter) of the closest pipe. Finally, while in preferred forms use is made of unitary hollow support columns, the invention may also be practiced by using spaced apart upright plates or similar expedients which are disposed about a pipe array.

In order to provide the most effective earthquake protection, the decoupling assemblies of the present invention may be used in conjunction with other devices designed to enhance the earthquake resistance of a given structure. For example, and referring again to FIG. 1, it will be seen that crossed flexible cables 112, 114 extend between and are embedded within the base 24 of frame 20 and foundation 26. At the time of installation, these cables are relatively loose and are maintained in a suspended condition (for example above a doorway 116) by means of a retaining spring 118. As those skilled in the art will appreciate, the cables 112, 114 serve to prevent undue lateral movement of the frame 20 relative to foundation 26 under exceptionally violent earthquake conditions. The connection of the cables 112, 114 can be effected by any convenient means, such as through the use of an embedded crosspin 120 within base 24, with the end of a cable looped around the crosspin and secured by connectors 122.

As an additional measure, reinforced concrete load-bearing walls 124 are advantageously provided between foundation 26 and base 24. In particular, the upper load-bearing surfaces of the walls 124 are disposed slightly below the engagement between the bearing means 32 and base 24. Thus, in the event of a complete failure, the building structure may settle upon the load-bearing walls to prevent complete collapse of the entire structure.

During normal use of the decoupling assemblies 22, the primary structural load is borne by the upright columns 46 or 72, through the medium of the individual bearing assemblies 54. The concrete-filled pipes carry only a minor load in compression. As described, the primary columns 46 or 72 have no shear and moment connectors with the supported structure.

Figure 5:
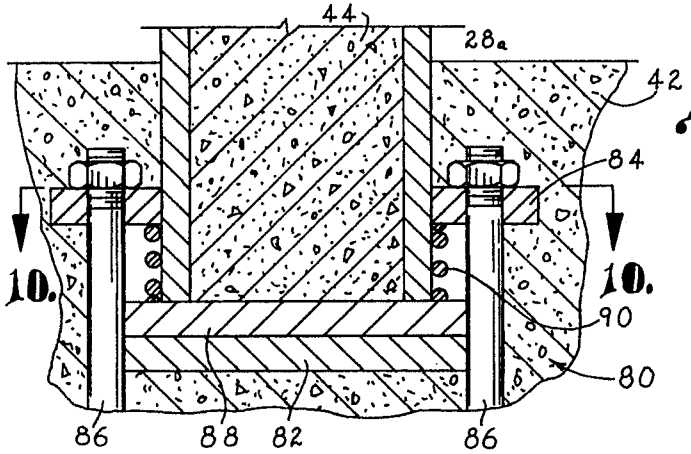
FIG. 5 is an enlarged vertical sectional view illustrating one preferred spring-biased coupling means for securing the lowermost ends of pipes to the underlying foundation of a structure.

In the event of a seismic disturbance, the concrete-filled pipes associated with the support columns serve to substantially reduce the transmissibility of ground acceleration to the isolated structure, and as a consequence also reduce interstory drift. The concrete fill within the individual pipes serves as a local stiffener and damper during movement. In particular, the concrete fill tends to fragment and dampen movement much in the manner of a shock absorber. The pipes also serve as tension rods during such occurrences, to assist in prevention of separation and overturning of the protected structure. In this connection, use of spring-biased pipe connectors of the type described in FIGS. 5 and 6 is particularly advantageous in that as overturning moments increase, the tension applied to retard overturning also increases. Finally, the concrete-filled pipes control the natural period of the protected structure and provide a restoring force to return the structure back to its neutral position after a seismic event.

The bearing assemblies support the structure and transmit eccentric loads to the support columns, in order to keep the structure in equilibrium while maintaining its stability under the motion of forced vibrations. Therefore, the bearings are designed to function much like roller supports with very little resistance to relatively lateral motions between the structure and the support columns.

The crossed cables 112, 114 serve as a non-linear spring to prevent excessive lateral displacement, i.e., the lateral resistance of the structure will be increased as needed. The load-bearing walls 124 are designed to be separate from the protected structure as long as the deformation is small. These walls become effective when the level of earthquake is excessive, i.e., when the vertical displacement induced by lateral deformation of the structure is large enough to make contact between the protected structure and the load-bearing walls, the walls provide additional bearing strength to support the deformed structure and to provide friction forces to absorb the kinetic energy and reduce the amplitude of oscillation.

The invention therefore provides a number of advantages not attainable with prior designs. For example, the decoupling assemblies of the invention are passive devices and can absorb both compressive and tensile loads. The assemblies are long lasting and experience little deterioration in strength and function over time; this is to be contrasted with damaging aging processes which occur in resilient rubber bearing pads heretofore used. Most importantly, however, the decoupling assemblies of the invention remain stable even under excessive, earthquake-induced lateral displacements to keep the protected structure in equilibrium both during and after strong earthquakes. At the same time, the assemblies provide high tensile strength to resist overturning moments.

While the primary utility of the invention has been described in terms of providing earthquake resistance, the invention is also useful in other contexts. For example, decoupling lateral stiffness from the supporting strength of columns can alleviate temperature induced stresses in long span rigid frame bridges.

We claim:

1. A stiffness decoupling assembly adapted to be used between a structure and an underlying foundation, the assembly comprising:

a plurality of elongated, relatively flexible, hollow pipes rigidly connected adjacent the upper ends thereof to the structure and extending downwardly toward the foundation, at least certain of the pipes being substantially filled with material for damping induced movement of the pipes;

a coupling means operatively coupling at least certain of the pipes to the foundation for resisting overturning of the structure;

a primary load-bearing member located in spaced relationship to the plurality of pipes, the load-bearing member resting upon the foundation and extending upward toward the structure and presenting an upper end; and a decoupling means for decoupling the lateral stiffness of the structure from the load-bearing strength so that the load of the structure is transferred to the load-bearing member without transferring shear or :moment forces, the decoupling means including bearing means interposed between the upper end of the load-bearing member and the structure for permitting the structure to bear on the load-bearing member while allowing relative lateral movement between the upper end and the structure.

2. The stiffness decoupling assembly of claim 1, said pipes being in spaced relationship to each other.

3. The stiffness decoupling assembly of claim 1, said pipes being bundled together in contact with one another.

4. The stiffness decoupling assembly of claim 1, said pipes being oriented in an array presenting peripheral pipes and at least one inner pipe, said coupling means securing said peripheral pipes to said foundation.

5. The stiffness decoupling assembly of claim 1, said damping material comprising concrete.

6. The stiffness decoupling assembly of claim 1, all of said pipes being substantially filled with said damping material.

7. The stiffness decoupling assembly of claim 1, said primary load-bearing member comprising a unitary, hollow column receiving therein said pipes.

8. The stiffness decoupling assembly of claim 7, said column being substantially square in cross-section.

9. The stiffness decoupling assembly of claim 7, said column being substantially circular in cross-section.

10. The stiffness decoupling assembly of claim 1, said bearing means including:

a base rigidly secured to the upper end of said load-bearing member; and a bearing pad mounted on said base and in engagement with said structure, said pad being formed of material having a relatively low coefficient of friction.

11. The stiffness decoupling assembly of claim 10, said bearing pad being formed of a material selected from the group consisting of bearing alloys formed of bronze, steel, lead, or sintered powdered metals, with or without lubricants.

12. The stiffness decoupling assembly of claim 10, said base including adjustable shim structure for adjusting the effective height of said bearing means.

13. The stiffness decoupling assembly of claim 1, said structure being formed at least partially of concrete, said pipes being embedded in said concrete.

14. The stiffness decoupling assembly of claim 1, including a plurality of spaced apart bearing means each interposed between the upper end of said load-bearing member and said structure for cooperatively supporting said structure.

15. The stiffness decoupling assembly of claim 1, including a load-bearing wall disposed slightly below the engagement between said bearing means and structure.

16. The stiffness decoupling assembly of claim 1, said coupling means comprising:

a pipe-receiving base rigidly secured to said foundation and presenting a lowermost support plate and an annular retaining ring disposed above said support plate, said retaining ring slidably receiving the lowermost end of a pipe;

an abutment plate affixed to the lowermost end of said slidably received pipe, said abutment plate being configured and arranged for captively retaining said pipe lowermost end between said support plate and retaining ring; and a coil spring between said abutment plate and retaining ring and disposed about a portion of the lowermost end of said pipe.

17. The stiffness decoupling assembly of claim 1, said coupling means comprising:

a base rigidly secured to said foundation and presenting an upwardly extending pin and an abutment plate secured to the upper end of said pin;

an engagement plate and a retaining ring secured to the lowermost end of a pipe to be coupled, said engagement plate being located in spaced upwardly from the lowermost end of the pipe and internally thereof, said retaining ring being located in spaced relationship and downwardly from said engagement plate, said retaining ring being annular and receiving said pin, said abutment plate and retaining ring cooperatively serving to retain the upper end of said pin between said engagement plate and retaining ring; and a coil spring located between said retaining ring and engagement plate and disposed about a portion of said pin received within said pipe.

18. The stiffness decoupling assembly of claim 1, including cable means extending between said structure and foundation and secured to each of the latter, said cable means serving to inhibit excessive relative movement between the structure and foundation.

19. The stiffness decoupling assembly of claim 1, said structure comprising a multi-story building.

20. The stiffness decoupling assembly of claim 1, said coupling means including structure for permitting limited upward shifting movement of said at least certain of said pipes against an increasing biasing force.

21. A stiffness decoupling assembly adapted to be used between a structure and an underlying foundation, said assembly comprising:

a plurality of elongated, relatively flexible, hollow pipes rigidly connected adjacent the upper ends thereof to said structure and extending downwardly toward said foundation, at least certain of said pipes being substantially filled with material for damping induced movement of said pipes;

means operatively coupling at least certain of said pipes to said foundation for resisting overturning of said structure;

a primary load-bearing member located in spaced relationship to said plurality of pipes, said load-bearing member resting upon said foundation and extending upwardly toward said structure and presenting an upper end; and bearing means interposed between the upper end of said load-bearing member and said structure for engaging both said upper end and structure and permitting relative lateral movement therebetween, said bearing means comprising a plurality of spaced-apart sliding bearing assemblies.

22. A stiffness decoupling assembly adapted to be used between a structure and an underlying foundation, the assembly comprising:

a plurality of elongated, relatively flexible, hollow pipes rigidly connected adjacent the upper ends thereof to the structure and extending downwardly toward the foundation, at least certain of the pipes being substantially filled with material for damping induced movement of the pipes;

a coupling means operatively coupling at least certain of the pipes to the foundation for resisting overturning of the structure;

a primary load-bearing member located in spaced relationship to the plurality of pipes, the load-bearing member resting upon the foundation and extending upward toward the structure and presenting an upper end, the plurality of pipes being spaced sufficiently from the primary load-bearing member to prevent significant contact between the pipes and the support member during induced movement of the pipes; and a bearing means interposed between the upper end of the load-bearing member and the structure for engaging both the upper end and the structure and for permitting relative lateral movement therebetween.

* * * * *